US011827330B2

(12) United States Patent
Covington

(10) Patent No.: US 11,827,330 B2
(45) Date of Patent: Nov. 28, 2023

(54) HANDS-FREE KAYAK STEERING SYSTEM

(71) Applicant: Christopher Covington, Strasburg, VA (US)

(72) Inventor: Christopher Covington, Strasburg, VA (US)

( * ) Notice: Subject to any disclaimer, the term of this patent is extended or adjusted under 35 U.S.C. 154(b) by 220 days.

(21) Appl. No.: 17/178,161

(22) Filed: Feb. 17, 2021

(65) Prior Publication Data

US 2021/0253216 A1 Aug. 19, 2021

Related U.S. Application Data

(63) Continuation-in-part of application No. 29/732,741, filed on Apr. 27, 2020.

(60) Provisional application No. 62/977,638, filed on Feb. 17, 2020.

(51) Int. Cl.

| | |
|---|---|
| ***B63H 25/48*** | (2006.01) |
| ***B63B 34/10*** | (2020.01) |
| ***B63H 5/125*** | (2006.01) |
| ***B63H 21/17*** | (2006.01) |
| ***B63B 79/10*** | (2020.01) |
| ***B63B 79/40*** | (2020.01) |
| ***B63H 25/02*** | (2006.01) |

(52) U.S. Cl.

CPC ..... *B63H 25/48* (2013.01); *B63B 34/10* (2020.02); *B63B 79/10* (2020.01); *B63B 79/40* (2020.01); *B63H 5/125* (2013.01); *B63H 21/17* (2013.01); *B63H 25/02* (2013.01); *B63B 2209/00* (2013.01)

(58) Field of Classification Search

CPC ..... B63H 25/48; B63H 25/02; B63H 5/125; B63H 21/17; B63H 20/007; B63B 79/40; B63B 79/10; B63B 34/10; B63B 2209/00

See application file for complete search history.

(56) References Cited

U.S. PATENT DOCUMENTS 650,558 A * 5/1900 Hatch ..... B63H 20/007 236/102
5,131,875 A 7/1992 Lee
6,132,267 A 10/2000 Campbell
(Continued)

FOREIGN PATENT DOCUMENTS

WO WO-2015048479 A1 * 4/2015 ..... B63B 35/71
WO WO2019016419 A1 1/2019

*Primary Examiner* — Stephen P Avila

(57) ABSTRACT

A hands-free kayak steering system is a system that enables users to maneuver small watercrafts without requiring physical steering by the user. The system may include a bridging base, a first maneuvering mechanism, a second maneuvering mechanism, a user controller, and a portable power source. The bridging base supports the user controller for the user to steer the watercraft using the feet. The first maneuvering mechanism and the second maneuvering mechanism enable the system to adjust to fit on the watercraft. In addition, the first maneuvering mechanism and the second maneuvering mechanism generate thrust to propel the watercraft in the desired direction. The user controller enables the user to selectively engage the first maneuvering mechanism and the second maneuvering mechanism to steer the watercraft in the desired direction. Finally, the portable power source provides the voltage necessary to power both the first maneuvering mechanism and the second maneuvering mechanism.

19 Claims, 11 Drawing Sheets

(56) References Cited

U.S. PATENT DOCUMENTS

| | | | | |
|---|---|---|---|---|
| 10,053,200 | B1 | 8/2018 | Koetsier et al. | |
| 10,618,621 | B1 * | 4/2020 | Rott | G05D 1/0206 |
| 2014/0364020 | A1 | 12/2014 | Stone et al. | |
| 2019/0337598 | A1 | 11/2019 | Langham | |

* cited by examiner

HANDS-FREE KAYAK STEERING SYSTEM

The current application is a continuation-in-part (CIP) application of the U.S. design application Ser. No. 29/732,741 filed on Apr. 27, 2020.

The current application also claims a priority to a U.S. provisional application Ser. No. 62/977,638 filed on Feb. 17, 2020.

FIELD OF THE INVENTION

The present invention generally relates to aquatic vehicles and outdoor activities. More specifically, the present invention provides a handsfree steering system with autopilot capabilities for small watercrafts such as kayaks.

BACKGROUND OF THE INVENTION

Kayaking is one of the most popular outdoor activities performed nowadays. Kayaking is relatively accessible and serves as a vehicle for both exercising and recreation. However, having full control of the watercraft while performing other activities can be difficult and requires experience. For example, kayakers may want to do fishing while kayaking, but being able to keep control of the kayak while fishing can almost be impossible. Other watercraft are equipped to enable users to perform multiple activities at once such as motorboats or even small ships. However, these watercrafts can be too big or inadequate for smaller or turbulent bodies of water such as rivers. Other alternatives include customizing the kayak with propellers, but the installation can be time consuming and expensive for some.

An objective of the present invention is to provide a hands-free kayak steering system that facilitates unobstructed fishing or other aquatic activities without requiring manual steering. The present invention is self-contained, portable by weighting approximately 10 pounds, and is equipped with quick and easy attachment means that enables the attachment of the present invention to the desired kayak in less than 10 seconds. The attachment means of the present invention also accommodate various sizes and different types of kayaks. Further, the present invention provides autopilot means to help the user perform other activities while the present invention steers the kayak under predetermined settings.

SUMMARY OF THE INVENTION

The present invention is a portable and easy to use hands-free kayak steering system. The present invention provides a pair of maneuvering mechanisms that propels the kayak in the desired direction. Each maneuvering mechanism includes a high-efficiency brushless motor propeller mounted outboard that is height and yaw adjustable for better steering control of the kayak. Further, the propellers can be controlled via a pair of pedals that enable the user to steer the kayak in the desired direction. The pair of pedals preferably include a right pedal and left pedal which steers the kayak right or left, respectively. In addition, each pedal is designed for directional control of the corresponding propeller so that the propellers can generate trust forward or backward, thus allowing the user to even steer in reverse. Further, a portable power source, such as a rechargeable battery pack, is provided to power the present invention while keeping an overall light weight. An auxiliary waterproof charging port can be included that allows the user to plug in additional batteries or even a solar array to recharge the main battery pack or to provide additional power to the maneuvering mechanisms. The present invention can be also be adjusted to be utilized with other aquatic vehicles such as canoes, paddle boards, etc. Furthermore, the present invention includes autopilot means to enable the user to perform other activities without having to manually control the present invention. The autopilot means can also help maintain the kayak at a desired trajectory or keep the kayak off the shoreline. A microcontroller may also be included to enable the operation of the autopilot mechanism to further liberate the user to perform other activities.

DETAILED DESCRIPTION OF THE INVENTION

All illustrations of the drawings are for the purpose of describing selected versions of the present invention and are not intended to limit the scope of the present invention.

Figure 1:
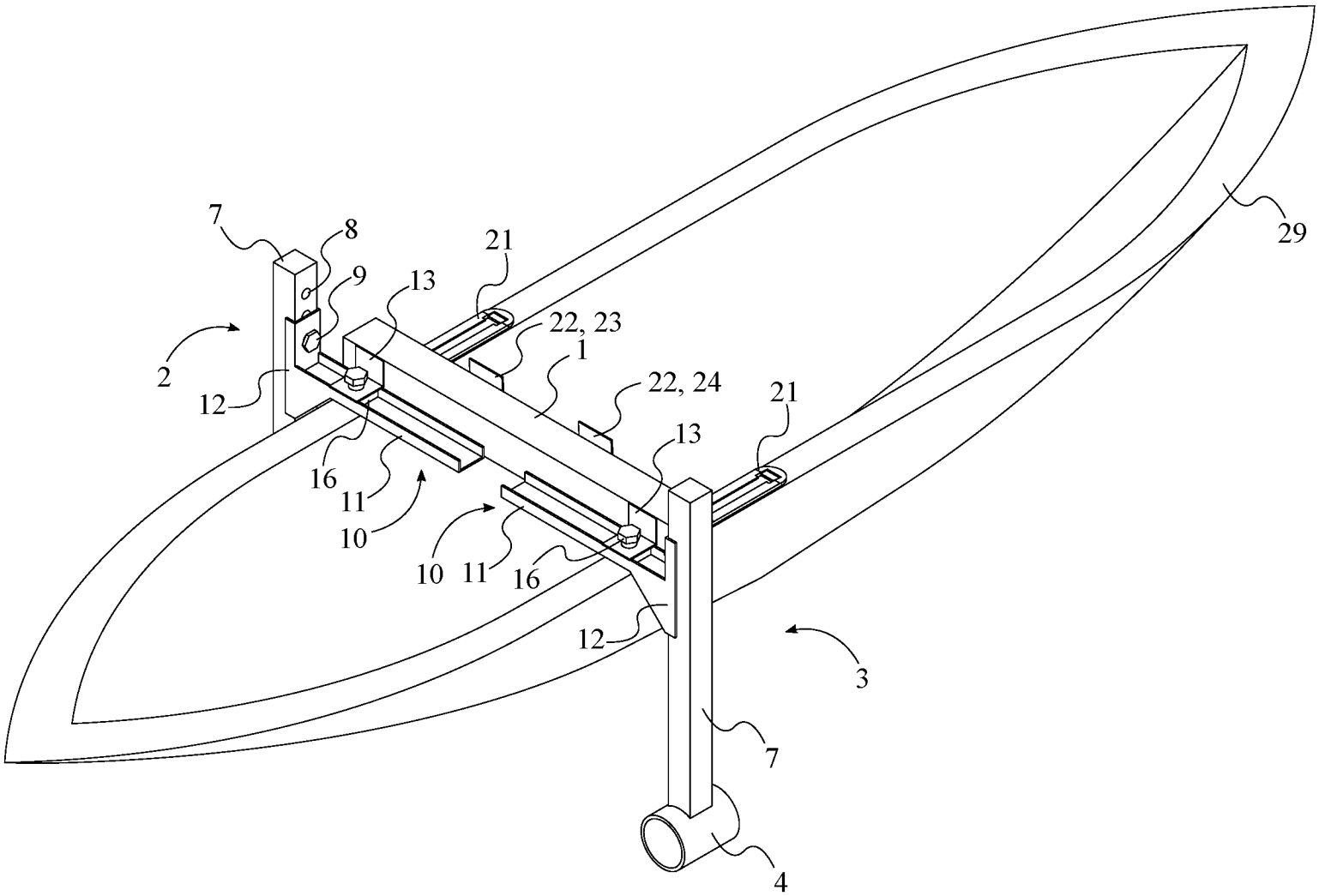
FIG. 1 is a top-front perspective view showing the present invention, wherein the present invention is shown mounted onto a watercraft.
Figure 2:
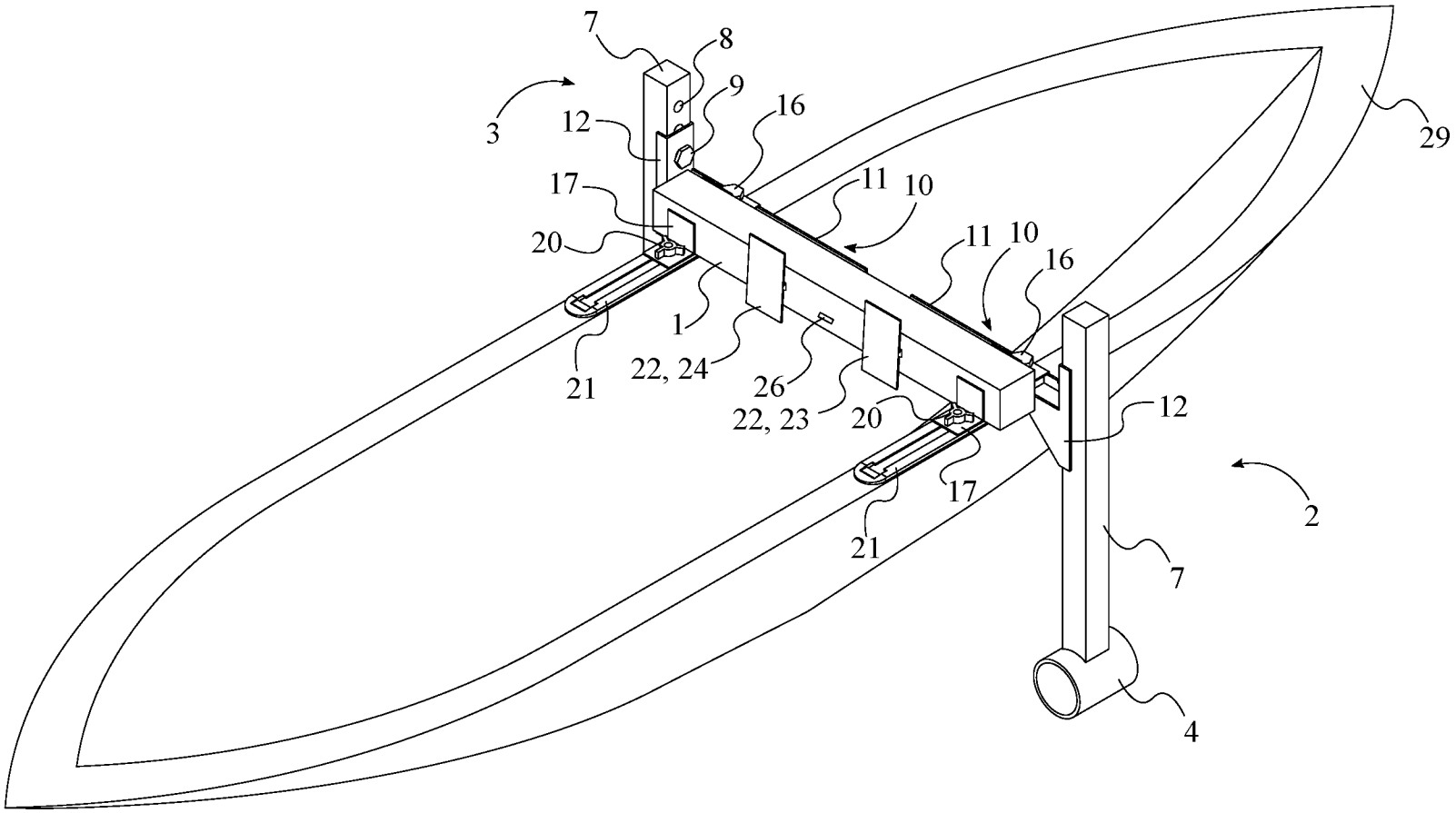
FIG. 2 is a top-rear perspective view showing the present invention, wherein the present invention is shown mounted onto a watercraft.
Figure 10:
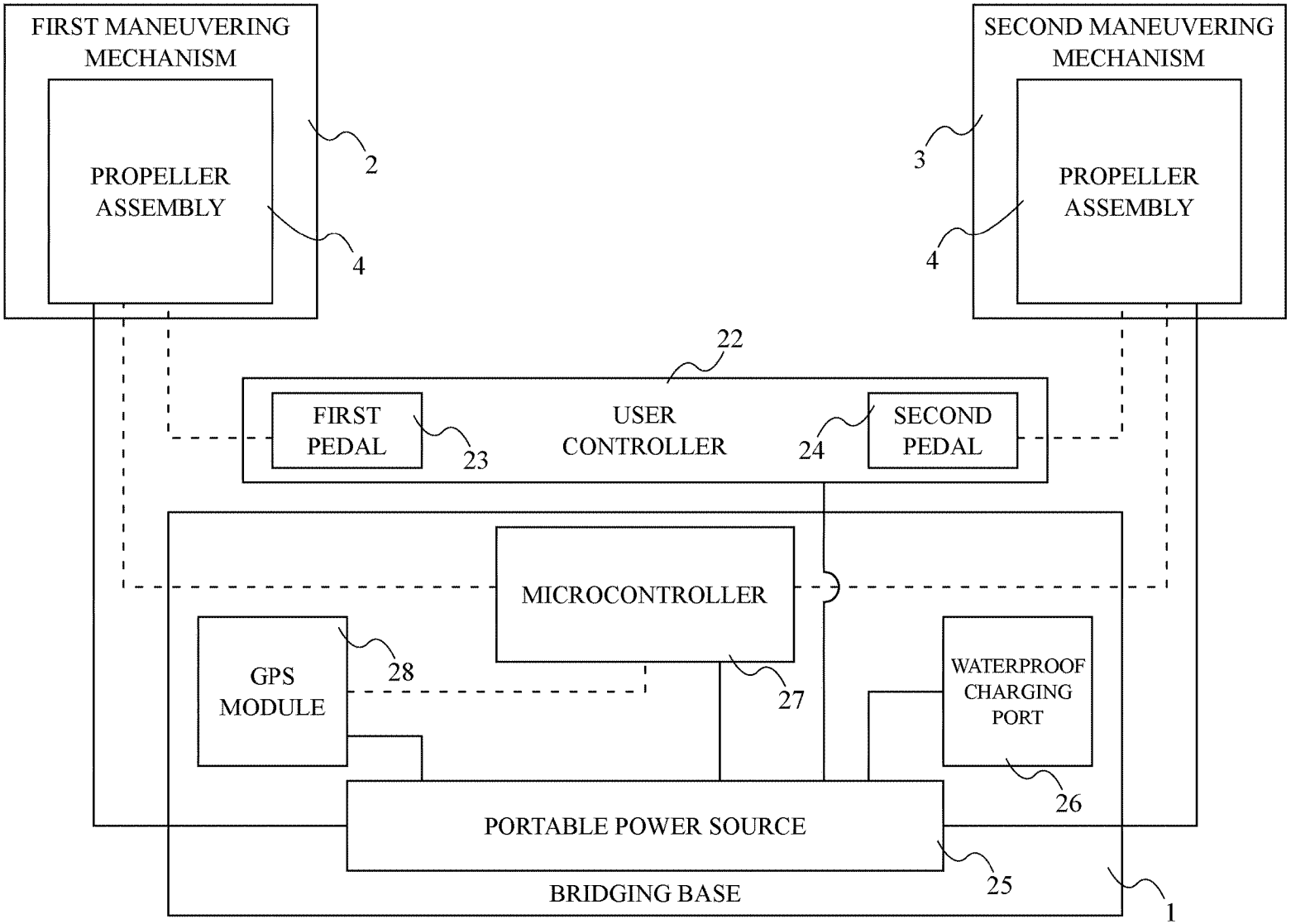
FIG. 10 is a schematic diagram showing the electrical and electronic connections of the present invention.

The present invention is a hands-free kayak steering system that enables users to maneuver small watercrafts such as a kayak without requiring physical steering by the user. As can be seen in FIGS. 1, 2, and 10, the present invention may comprise a bridging base 1, a first maneuvering mechanism 2, a second maneuvering mechanism 3, a user controller 22, and a portable power source 25. The bridging base 1 supports the user controller 22 for the user to manually steer the watercraft 29 using the feet. The first maneuvering mechanism 2 and the second maneuvering mechanism 3 enable the adjustment of the present invention so that the present invention can fit onto the watercraft 29. In addition, both the first maneuvering mechanism 2 and the second maneuvering mechanism 3 generate thrust to propel the watercraft 29 towards the desired direction. The user controller 22 enables the user to selectively actuate the first maneuvering mechanism 2 and the second maneuvering mechanism 3 to steer the watercraft 29 in the desired direction. Finally, the portable power source 25 provides the voltage necessary to power both the first maneuvering mechanism 2 and the second maneuvering mechanism 3 as necessary.

The general configuration of the aforementioned components enables the user to comfortably perform other activities such as fishing without having to physically steer the watercraft 29. As can be seen in FIG. 1 through 5, the first maneuvering mechanism 2 and the second maneuvering mechanism 3 each comprises a propeller assembly 4, a variable-depth post 7, and a quick-connect bracket 10. The propeller assembly 4 provides the thrust necessary for propulsion and maneuvering. The variable-depth post 7 enables the adjustment of the depth of the propeller assembly 4 to accommodate for different thrust levels. The quick-connect bracket 10 connects the variable-depth post 7 to the bridging base 1. In addition, the quick-connect bracket 10 facilitates the connection of the present invention to the watercraft 29. The propeller assembly 4 is terminally connected to the variable-depth post 7 so that any other portion of the present invention does not interfere with the directional thrust generated by the propeller assembly 4. The quick-connect bracket 10 is laterally positioned to the variable-depth post 7, offset from the propeller assembly 4, to support the variable-depth post 7. In addition, the quick-connect bracket 10 is movably mounted along the variable-depth post 7 to adjust the depth of the variable-depth post 7. The quick-connect bracket 10 of the first maneuvering mechanism 2 and the quick-connect bracket 10 of the second maneuvering mechanism 3 are positioned opposite to each other along the bridging base 1, which allows the variable-depth post 7 of the first maneuvering mechanism 2 to be positioned on one side of a kayak and allows the variable-depth post 7 of the second maneuvering mechanism 3 to be positioned on the other side of the kayak. Further, the quick-connect bracket 10 of the first maneuvering mechanism 2 and the quick-connect bracket 10 of the second maneuvering mechanism 3 are laterally mounted to the bridging base 1 so that the variable-depth post 7 and the propeller assembly 4 can be easily positioned into the water. Furthermore, in order to provide the voltage necessary for the operation of the propeller assembly 4, the portable power source 25 is electrically connected to the propeller assembly 4 of the first maneuvering mechanism 2 and the propeller assembly 4 of the second maneuvering mechanism 3, as can be seen in FIG. 10. Similarly, in order to enable the user to control the desired propeller assembly 4, the user controller 22 is communicably coupled to the propeller assembly 4 of the first maneuvering mechanism 2 and the propeller assembly 4 of the second maneuvering mechanism 3. In some embodiments, the user controller 22 can be hard-wired to the corresponding propeller assembly 4 using waterproof wiring.

Figure 8:
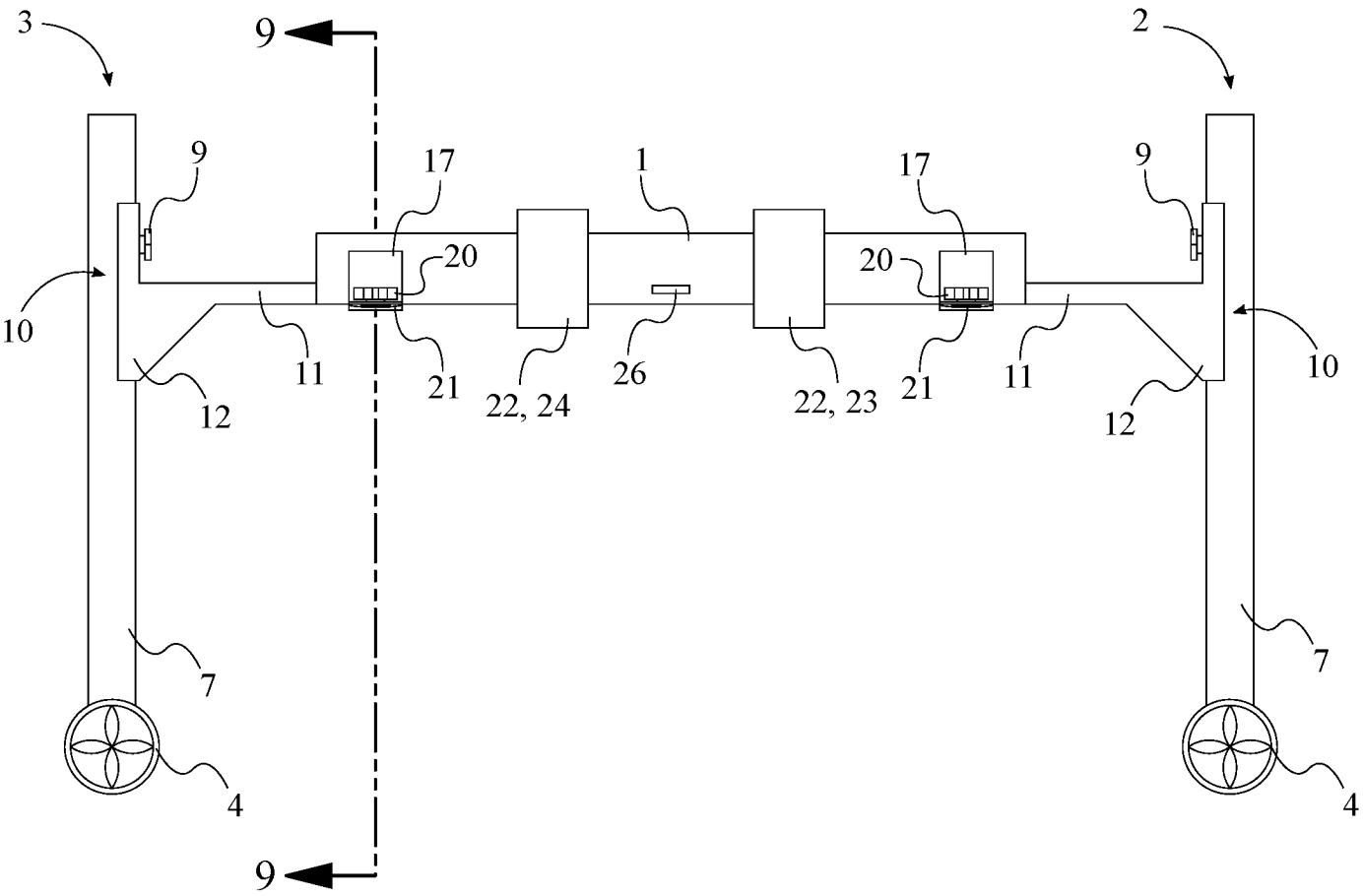
FIG. 8 is a rear view showing the present invention, wherein the overall width of the present invention has been increased and the depth of the variable-depth posts has been increased.

As can be seen in FIGS. 2, 8, and 10, in order to enable the user to interact with the user controller 22, the user controller 22 is mounted onto the bridging base 1 so that the user controller 22 is reachable by the user. The portable power source 25 is also electrically connected to the user controller 22 to transmit the voltage necessary for the operation of the user controller 22. The user controller 22 is preferably designed to enable the user to control the desired propeller assembly 4 using the feet. To do so, the user controller 22 may comprise a first pedal 23 and a second pedal 24. The first pedal 23 is positioned adjacent to the first maneuvering mechanism 2 to provide an easy association to the positioning of the propeller assembly 4 of the first maneuvering mechanism 2. On the other hand, the second pedal 24 is positioned adjacent to the second maneuvering mechanism 3 to similarly provide an easy association to the positioning of the propeller assembly 4 of the second maneuvering mechanism 3. The first pedal 23 and the second pedal 24 are laterally positioned to the bridging base 1 so that the first pedal 23 and the second pedal 24 can be reached by the feet of the user. In addition, the first pedal 23 is pivotally mounted to the bridging base 1 so that the user can selectively engage the first pedal 23 with one foot. Likewise, the second pedal 24 is pivotally mounted to the bridging base 1 so that the second pedal 24 could also be engaged with the other foot. The first pedal 23 and the second pedal 24 each preferably has a central fulcrum, enabling both to be pivoted clockwise and counterclockwise. In addition, the first pedal 23 is electronically connected to the propeller assembly 4 of the first maneuvering mechanism 2. Likewise, the second pedal 24 is electronically connected to the propeller assembly 4 of the second maneuvering mechanism 3. Therefore, the user can selectively actuate the propeller assembly 4 of the first maneuvering mechanism 2 and the propeller assembly 4 of the second maneuvering mechanism 3.

Figure 5:
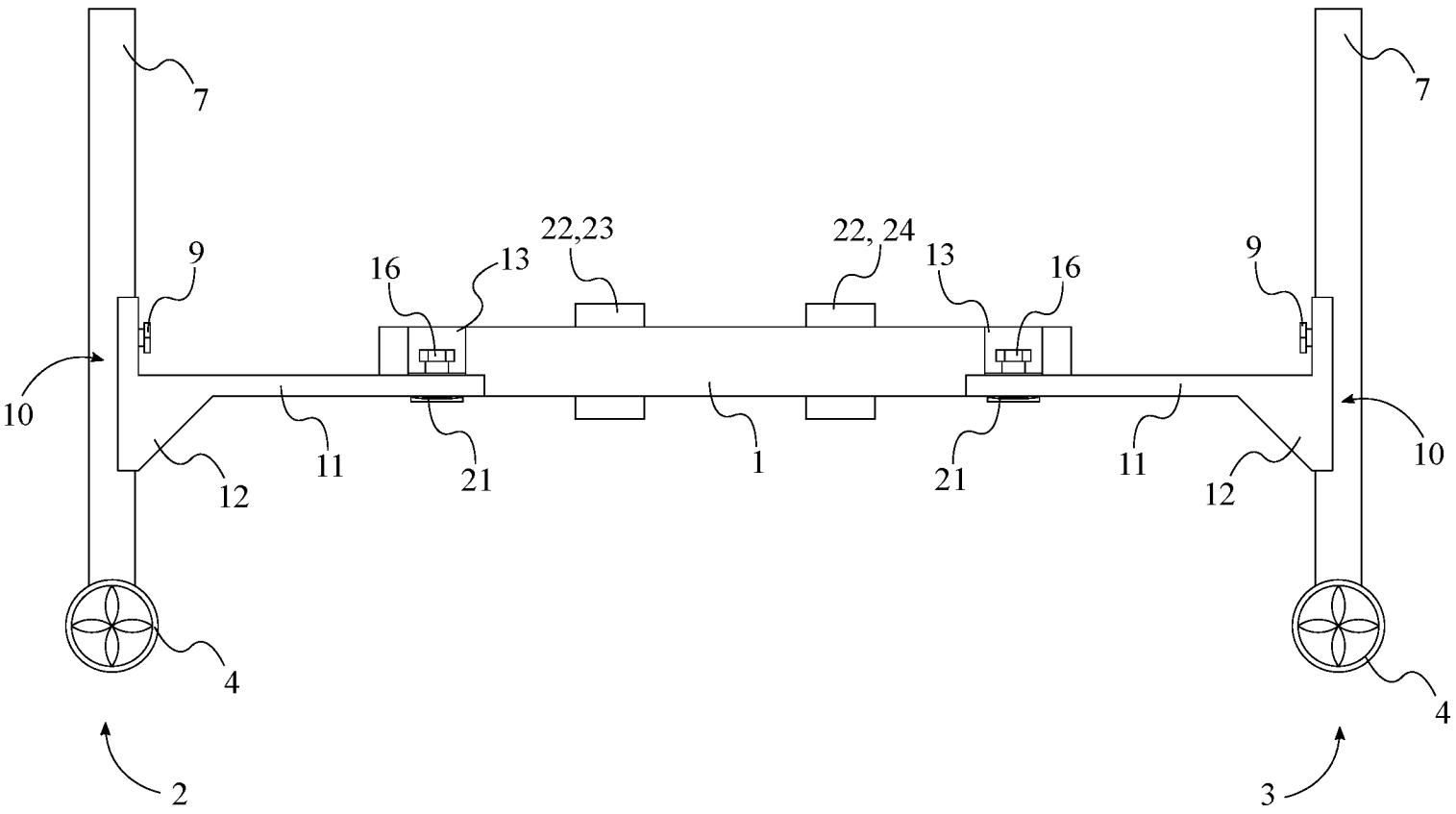
FIG. 5 is a front view showing the present invention, wherein the overall width of the present invention has been increased and the depth of the variable-depth posts has been decreased.
Figure 6:
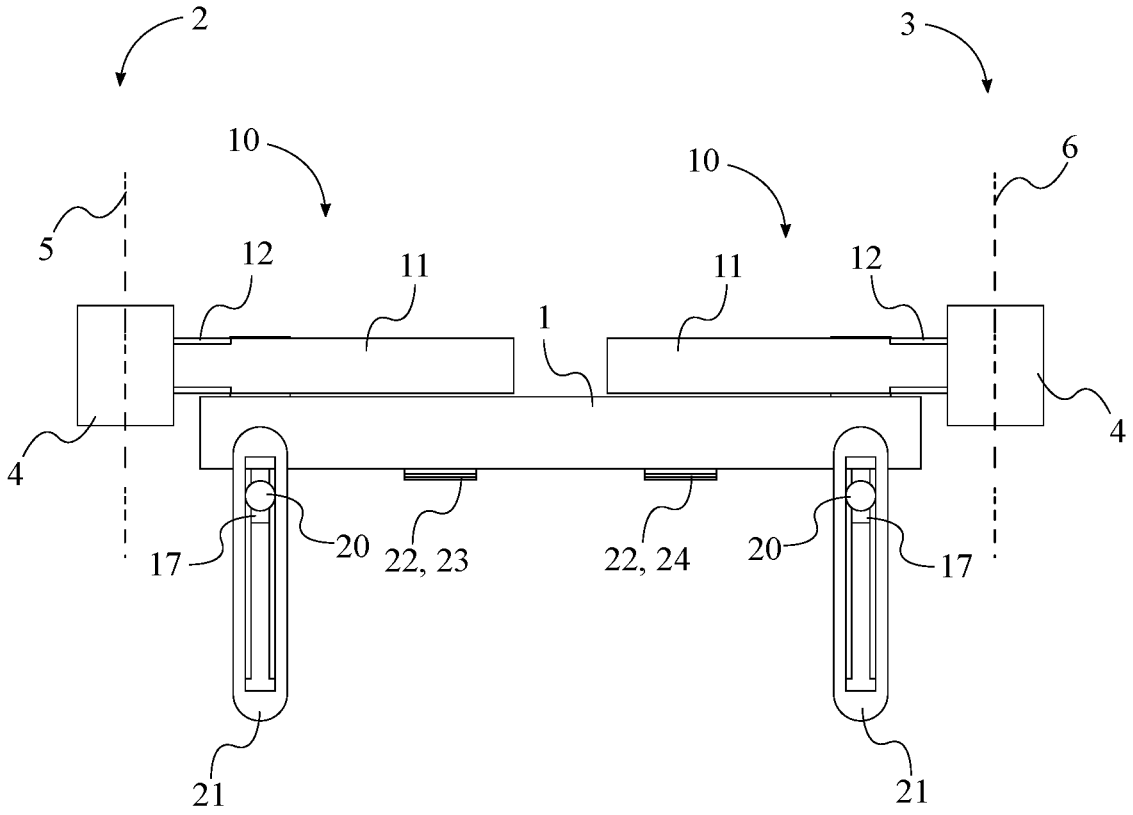
FIG. 6 is a bottom view showing the present invention.
Figure 7:
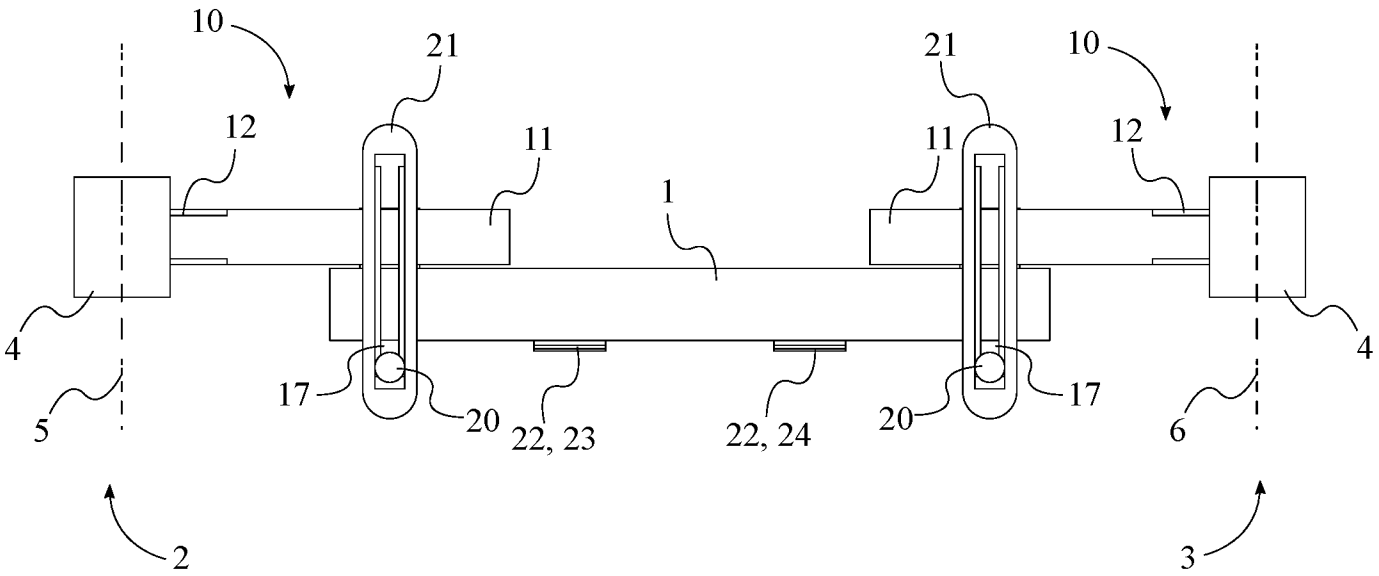
FIG. 7 is a bottom view showing the present invention, wherein the present invention has been slid backwards along the boat-accessory rails and the overall width has been increased.

In addition to the selective operation of the propeller assembly 4 of both the first maneuvering mechanism 2 and the second maneuvering mechanism 3, the present invention enables greater freedom of operation to generate thrust forward or backward as necessary. As can be seen in FIG. 5 through 7, the variable-depth post 7 of the first maneuvering mechanism 2 is positioned perpendicular to the bridging base 1 so that the propeller assembly 4 does not cause undesired torque on the bridging base 1. Likewise, the variable-depth post 7 of the second maneuvering mechanism 3 is positioned perpendicular to the bridging base 1. Further, a first rotation axis 5 of the propeller assembly 4 of the first maneuvering mechanism 2 is positioned orthogonal to the variable-depth post 7 of the first maneuvering mechanism 2 and the bridging base 1 so that the thrust generated is able to propel a kayak with proper maneuvering. Likewise, a second rotation axis 6 of the propeller assembly 4 of the second maneuvering mechanism 3 is positioned orthogonal to the variable-depth post 7 of the second maneuvering mechanism 3 and the bridging base 1. Thus, the user can selectively engage the first pedal 23 and/or the second pedal 24 as desired to actuate the appropriate propeller assembly 4 to generate thrust in the desired direction, enabling the steering of the watercraft 29 forward, backward, left, or right. In other embodiments, the propeller assembly 4 may be adjusted to have a rotation axis that can be angled for better steering control.

Figure 3:
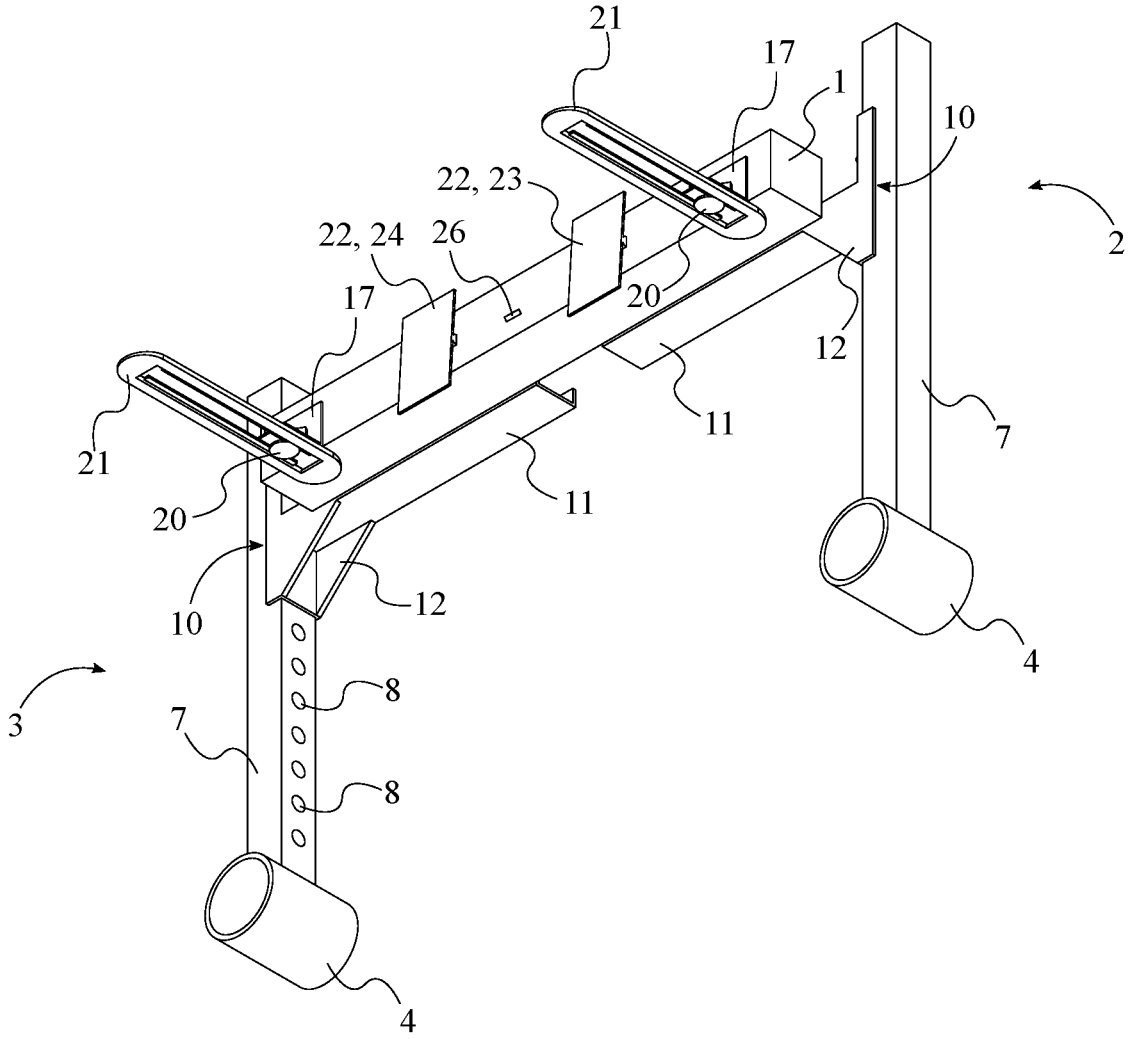
FIG. 3 is a bottom-rear perspective view showing the present invention.

In order to enable the recharging of the portable power source 25, the present invention may further comprise a waterproof charging port 26, as can be seen in FIGS. 3 and 10. The waterproof charging port 26 enables the recharging of the portable power source 25 by connecting the portable power source 25 to an external power source via the waterproof charging port 26. The waterproof charging port 26 is hermetically integrated into the bridging base 1 to prevent water from entering the bridging base 1. The portable power source 25 is mounted within the bridging base 1 to keep the portable power source isolated from the surroundings. Finally, the portable power source 25 is electrically connected to the waterproof charging port 26 to transmit the power from the external power source to the portable power source 25. In some embodiments, the present invention may further include one or more solar arrays electrically connected to the waterproof charging port 26 to recharge the portable power source 25 or to provide additional power to the present invention. In other embodiments, additional portable power sources can be carried along the present invention to complement the portable power source 25 within the bridging base 1.

Figure 4:
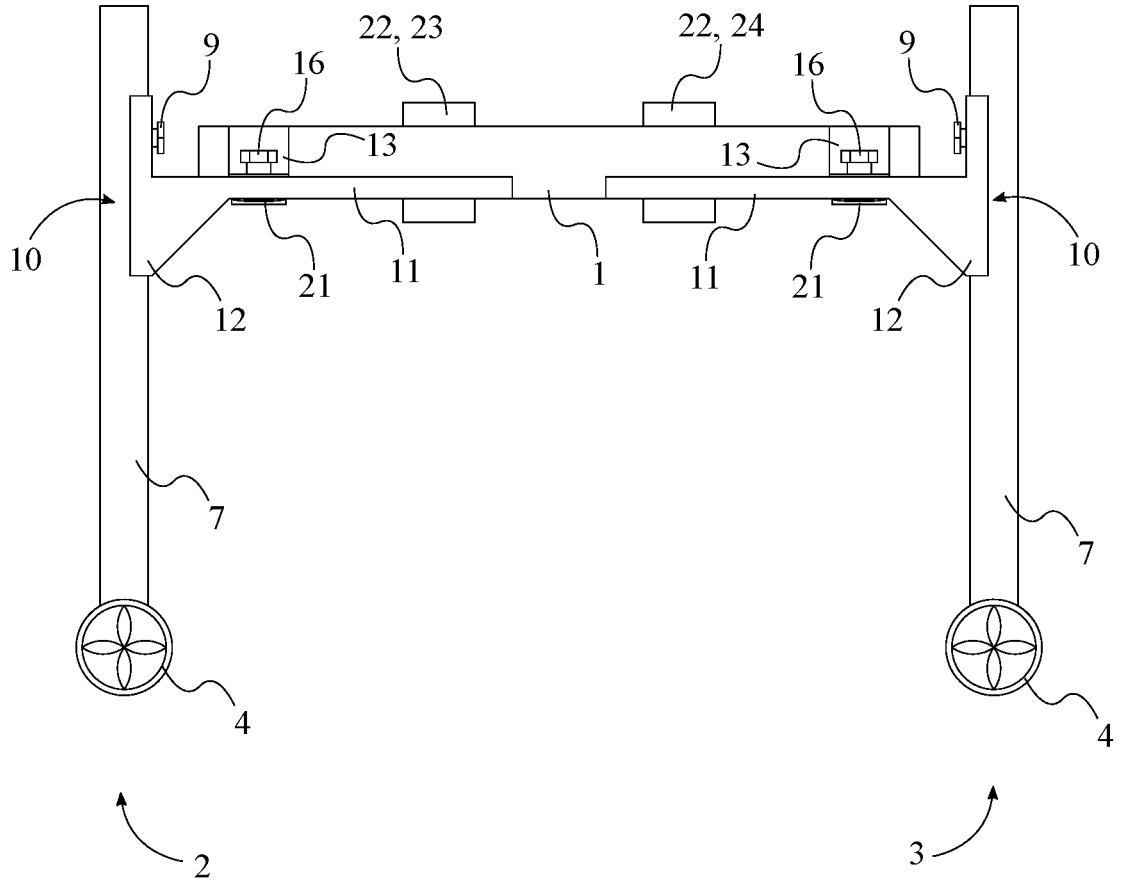
FIG. 4 is a front view showing the present invention.

As previously mentioned, the quick-connect bracket 10 enables the mounting of the present invention to the desired watercraft 29. In addition, as can be seen in FIGS. 1 and 2, the quick-connect bracket 10 enables the present invention to fit on the watercraft 29. As can be seen in FIGS. 4 and 5, the quick-connect bracket 10 may comprise a support rail 11 and a post guide 12. The support rail 11 enables the mounting of the present invention to the watercraft 29, while the post guide 12 enables the depth adjustment of the variable-depth post 7. The support rail 11 is positioned parallel to the bridging base 1 to keep the quick-connect bracket 10 parallel to the bridging base 1. The support rail 11 is also movably connected to the bridging base 1 so that the present invention can be adjusted to fit on the watercraft 29. The support rail 11 can be moved closer to the center of the bridging base 1 to accommodate a thinner watercraft 29 or the support rail 11 can be moved closer to the ends of the bridging base 1 to accommodate a wider watercraft 29. On the other hand, the post guide 12 is terminally mounted to the support rail 11 to maintain the variable-depth post 7 separate from the bridging base 1. The post guide 12 is also movably mounted along the variable-depth post 7 so that the variable-depth post 7 can be raised or lowered as necessary.

Figure 9:
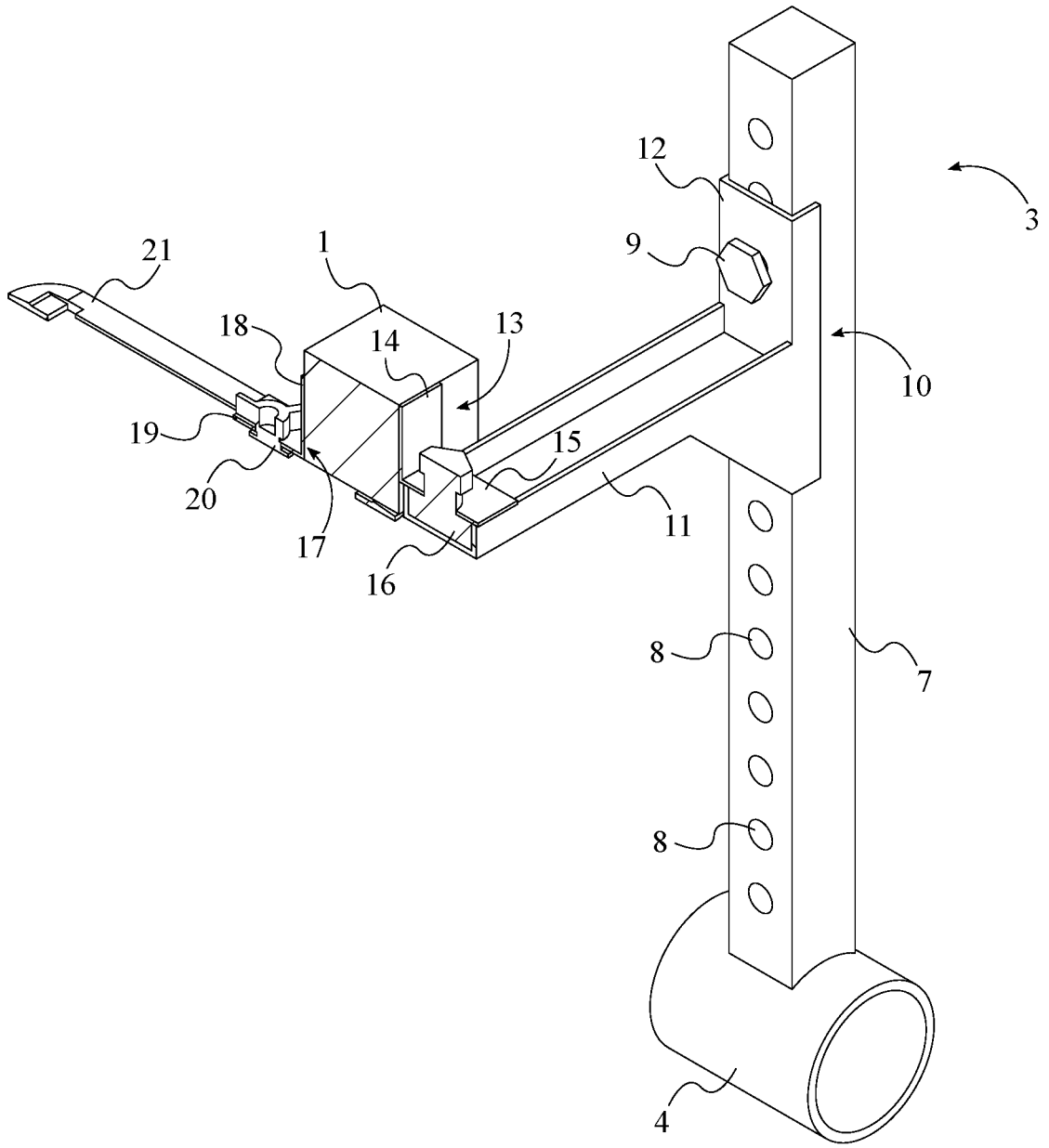
FIG. 9 is an enlarged cross-sectional perspective view taken along line 9-9 in FIG. 8.

As previously mentioned, the present invention can be quickly adjusted to the desired watercraft 29 without requiring major installation. As can be seen in FIGS. 5 and 9, the first maneuvering mechanism 2 and the second maneuvering mechanism 3 may each further comprise a forward L-shaped bracket 13 and a clampable carriage 16. The forward L-shaped bracket 13 and the clampable carriage 16 work together to easily adjust the overall width of the present invention to the width of the watercraft 29. The forward L-shaped bracket 13 comprises a first forward leg 14 and a second forward leg 15 arranged to form the L-shape of the bracket. The first forward leg 14 is laterally connected to the bridging base 1, which positions the forward L-shaped bracket 13 to easily secure the bridging base 1 to the quick-connect bracket 10. The second forward leg 15 is connected perpendicular to the first forward leg 14 to maintain the clampable carriage 16 perpendicular to the bridging base 1. The clampable carriage 16 is mounted through the second forward leg 15 to secure the clampable carriage 16 to the forward L-shaped bracket 13. In addition, the clampable carriage 16 is slidably engaged along the support rail 11 to facilitate the movement of the support rail 11 along the bridging base 1. Thus, the user can adjust the positions of the first maneuvering mechanism 2 and the second maneuvering mechanism 3 to match the width of the watercraft 29.

Figure 11:
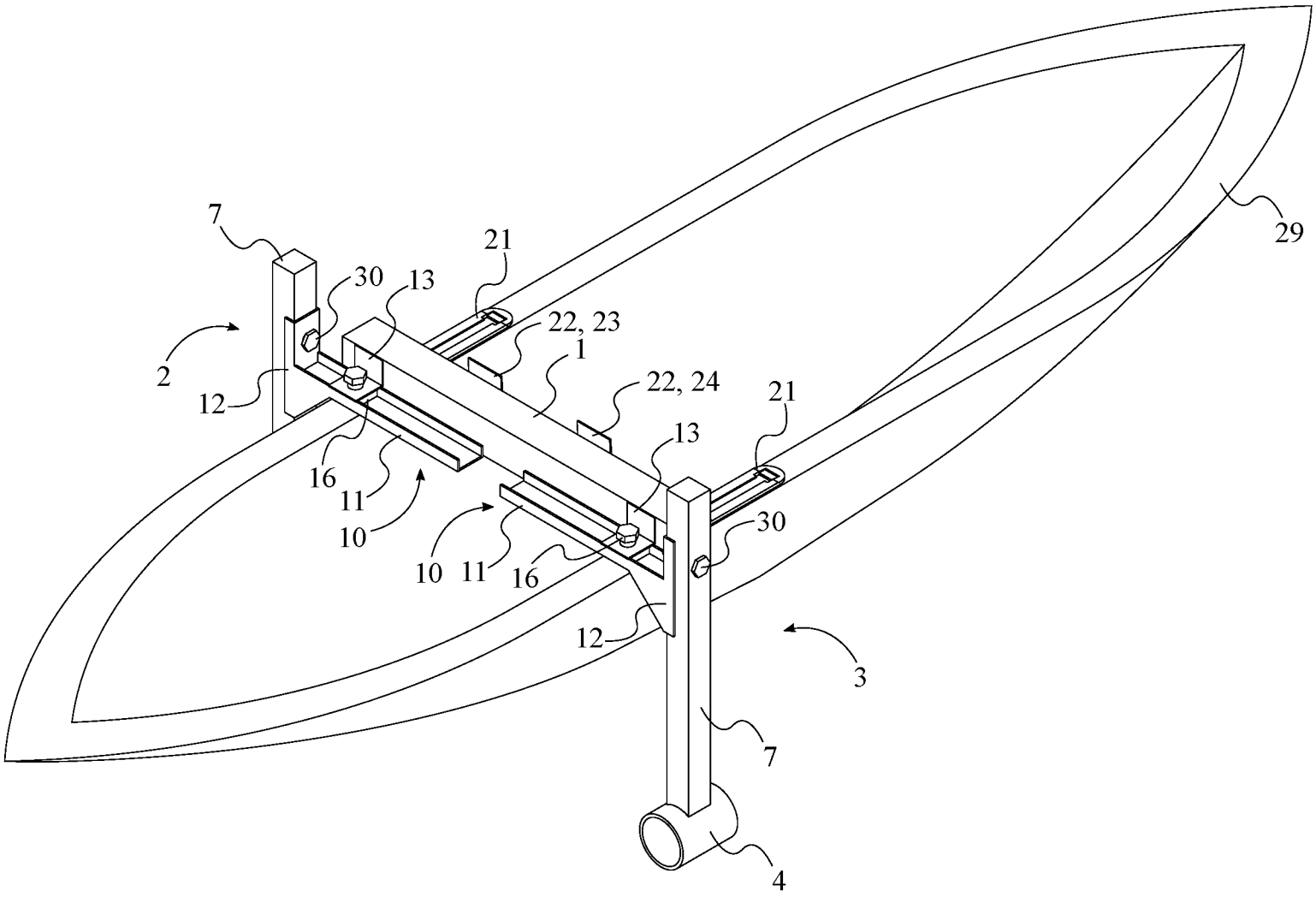
FIG. 11 is a top-front perspective view showing the present invention, wherein the present invention is shown mounted onto a watercraft and uses clamps to attach the variable depth posts to the quick-connect brackets.

In some embodiments, in order to secure the variable-depth post 7 to the post guide 12, the first maneuvering mechanism 2 and the second maneuvering mechanism 3 may each further comprise a clamp 30 that enables the user to manually adjust the depth of the variable-depth post 7. The clamp 30 is preferably a pressure clamp with T-nut slide that can be engaged to press the variable-depth post 7 against the post guide 12. Thus, the variable-depth post 7 is secured to the post guide 12 by friction. As can be seen in FIG. 11, the post guide 12 is movably mounted along the variable-depth post 7 by the clamp so that the user can easily adjust the depth of the variable-depth post 7. Thus, in order to adjust the depth of the variable-depth post 7, the user loosens the clamp 30, raises or lowers the variable-depth post 7 as necessary, and tightens the clamp 30 to lock the variable-depth post 7 in position. Alternatively, the present invention may utilize different mechanisms to secure the variable-depth post 7 to the post guide 12 while enabling depth adjustment of the same.

In some other embodiments, the first maneuvering mechanism 2 and the second maneuvering mechanism 3 may each further comprise a plurality of orifices 8 and a hand fastener 9. As can be seen in FIGS. 3 and 8, the plurality of orifices 8 and the hand fastener 9 enable users to manually secure the variable-depth post 7 at a desired depth along the post guide 12. The plurality of orifices 8 is distributed along the variable-depth post 7 so that the variable-depth post 7 can be raised and lowered to different depths. The plurality of orifices 8 is positioned normal to the post guide 12 to orient the plurality of orifices 8 in such a way that the hand fastener 9 can easily engage one of the plurality of orifices 8. The hand fastener 9 is rotatably connected through the post guide 12 so that the user can manually fasten the hand fastener 9. Finally, the hand fastener 9 is engaged with a selected orifice from the plurality of orifices 8 to secure the variable-depth post 7 to the post guide 12. The user can easily adjust the depth of the variable-depth post 7 by disengaging the hand fastener 9 and lowering, or raising, the variable-depth post 7 as desired, and reengaging the hand fastener 9 to a new orifice matching the desired depth of the variable-depth post 7.

In order to enable the user to quickly mount and dismount the present invention from the watercraft 29, the user can utilize the existing structure of the watercraft 29 to quickly mount and dismount the present invention to/from the watercraft 29. As can be seen in FIGS. 2, 3, and 9, the first maneuvering mechanism 2 and the second maneuvering mechanism 3 may each further comprise a rearward L-shaped bracket 17 and a rail fastener 20 that can be connected to an accessory track mount. Like the forward L-shaped bracket 13, the rearward L-shaped bracket 17 comprises a first rearward leg 18 and a second rearward leg 19. The rearward L-shaped bracket 17 is positioned opposite to the quick-connect bracket 10 about the bridging base 1 to prevent the rearward L-shaped bracket 17 from interfering with the quick-connect bracket 10. The first rearward leg 18 is laterally connected to the bridging base 1, which positions the rearward L-shaped bracket 17 to easily secure the bridging base 1 to the watercraft 29. The second rearward leg 19 is connected perpendicular to the first rearward leg 18 to form the L-shape of the rearward L-shaped bracket 17 and to maintain user controller 22 facing the body of the user. Further, the rail fastener 20 is mounted through the second rearward leg 19 so that the user can manually engage or disengage the rail fastener 20 without removing the rail fastener 20 from the rearward L-shaped bracket 17. Thus, in order to mount the present invention to the desired watercraft 29, the user inserts the free end of the rail fastener 20 into an opening of the accessory track mount, sliding the rail fastener 20 until locking position. Once in the locking position, the user can engage the rail fastener 20 to secure the rearward L-shaped bracket 17 to the accessory track mount. Consequently, the bridging base 1 and the rest of the invention are secured to the watercraft 29. Alternatively, to dismount the present invention from the watercraft 29, the user just disengages the rail fastener 20 which enables the user to remove the rearward L-shaped bracket 17 from the accessory track mount. Therefore, the user can easily mount or dismount the present invention from the watercraft 29 without tools.

In other embodiments, the present invention can include its own mount mechanism to easily mount and dismount the present invention. As can be seen in FIGS. 2, 3, and 9, the first maneuvering mechanism 2 and the second maneuvering mechanism 3 may each further comprise a boat-accessory rail 21 that enables easy mounting and dismounting of the present invention. The boat-accessory rail 21 is positioned perpendicular to the bridging base 1 to match the L shape of the rearward L-shaped bracket 17. Like the accessory track mount, the boat-accessory rail 21 is preferably designed to be fastened onto the sides of the watercraft 29, adjacent to the bow of the watercraft 29. In addition, the boat-accessory rail 21 provides one or more rail openings through which the free end of the rail fastener 20 can be inserted. Then, the rail fastener is engaged into the boat-accessory rail 21 to secure the rearward L-shaped bracket 17 to the boat-accessory rail 21. Thus, like the accessory track mount, the present invention can be easily mounted or dismounted without use of tools.

Furthermore, in addition to the mounting capabilities of the present invention, the present invention also enables the user to set the user controller 22 to an autopilot configuration. In the autopilot configuration, the user configures the operation of the propeller assembly 4 of the first maneuvering mechanism 2 and the propeller assembly 4 of the second maneuvering mechanism 3 to an automatic setting where the watercraft 29 is steered in a preconfigured motion. For example, the user can configure the present invention to automatically steer the watercraft 29 at a set distance from the shore, stay in a straight route along a river, or maintain the watercraft 29 in position at a set location. To do so, the present invention may further comprise a microcontroller 27 and a global positioning system (GPS) module 28, as can be seen in FIG. 10. The microcontroller 27 is preferably designed to receive user input to configure the settings of the autopilot configuration. The GPS module 28 provides location data to enable the microcontroller 27 to adjust the operation of the propeller assembly 4 of the first maneuvering mechanism 2 and the propeller assembly 4 of the second maneuvering mechanism 3 automatically according to the preconfigured settings. The microcontroller 27 and the GPS module 28 are mounted within the bridging base 1 to keep both protected from water. In addition, the microcontroller 27 is electronically connected to the GPS module 28, the propeller assembly 4 of the first maneuvering mechanism 2, and the propeller assembly 4 of the second maneuvering mechanism 3 to transmit command signals to each other. The portable power source 25 is also electrically connected to the microcontroller 27 and the GPS module 28 to provide voltage to the microcontroller 27 and the GPS module 28 so that each may be able to operate as necessary. Further, the microcontroller 27 may be configured remotely via a hand controller or a mobile application on a wireless electronic device. Thus, the user can configure a desired path or motion that the watercraft 29 is set to be maintained on the microcontroller 27. The GPS module 28 provides the location data to the microcontroller 27 that is used to automatically steer the watercraft 29 according to the preset path or motion. In other embodiments, other steering features can be provided that further facilitate the steering, manual or automatic, of the watercraft 29 by the user.

Although the invention has been explained in relation to its preferred embodiment, it is to be understood that many other possible modifications and variations can be made without departing from the spirit and scope of the invention as hereinafter claimed.

What is claimed is:

1. A hands-free kayak steering system comprising:

a bridging base;

a first maneuvering mechanism;

a second maneuvering mechanism;

a user controller;

a portable power source;

a waterproof charging port;

the first maneuvering mechanism and the second maneuvering mechanism each comprising a propeller assembly, a variable-depth post, and a quick-connect bracket;

the propeller assembly being terminally connected to the variable-depth post;

the quick-connect bracket being laterally positioned to the variable-depth post, offset from the propeller assembly;

the quick-connect bracket being movably mounted along the variable-depth post;

the quick-connect bracket of the first maneuvering mechanism and the quick-connect bracket of the second maneuvering mechanism being positioned opposite to each other along the bridging base;

the quick-connect bracket of the first maneuvering mechanism and the quick-connect bracket of the second maneuvering mechanism being laterally mounted to the bridging base;

the portable power source being electrically connected to the propeller assembly of the first maneuvering mechanism and the propeller assembly of the second maneuvering mechanism;

the user controller being communicably coupled to the propeller assembly of the first maneuvering mechanism and the propeller assembly of the second maneuvering mechanism;

the waterproof charging port being hermetically integrated into the bridging base;

the portable power source being mounted within the bridging base; and, the portable power source being electrically connected to the waterproof charging port.

2. The hands-free kayak steering system as claimed in claim 1 comprising:

the user controller being mounted onto the bridging base; and, the portable power source being electrically connected to the user controller.

3. The hands-free kayak steering system as claimed in claim 2 comprising:

the user controller comprising a first pedal and a second pedal;

the first pedal being positioned adjacent to the first maneuvering mechanism;

the second pedal being positioned adjacent to the second maneuvering mechanism;

the first pedal and the second pedal being laterally positioned to the bridging base;

the first pedal being pivotally mounted to the bridging base;

the second pedal being pivotally mounted to the bridging base;

the first pedal being electronically connected to the propeller assembly of the first maneuvering mechanism; and, the second pedal being electronically connected to the propeller assembly of the second maneuvering mechanism.

4. The hands-free kayak steering system as claimed in claim 1 comprising:

the variable-depth post of the first maneuvering mechanism being positioned perpendicular to the bridging base;

the variable-depth post of the second maneuvering mechanism being positioned perpendicular to the bridging base;

a first rotation axis of the propellor assembly of the first maneuvering mechanism being positioned orthogonal to the variable-depth post of the first maneuvering mechanism and the bridging base; and, a second rotation axis of the propellor assembly of the second maneuvering mechanism being positioned orthogonal to the variable-depth post of the second maneuvering mechanism and the bridging base.

5. The hands-free kayak steering system as claimed in claim 1 comprising:

the quick-connect bracket comprising a support rail and a post guide;

the support rail being positioned parallel to the bridging base;

the support rail being movably connected to the bridging base;

the post guide being terminally mounted to the support rail; and, the post guide being movably mounted along the variable-depth post.

6. The hands-free kayak steering system as claimed in claim 5 comprising:

the first maneuvering mechanism and the second maneuvering mechanism each further comprising a forward L-shaped bracket and a clampable carriage;

the forward L-shaped bracket comprises a first forward leg and a second forward leg;

the first forward leg being laterally connected to the bridging base the second forward leg being connected perpendicular to the first forward leg;

the clampable carriage being mounted through the second forward leg; and, the clampable carriage being slidably engaged along the support rail.

7. The hands-free kayak steering system as claimed in claim 5 comprising:

the first maneuvering mechanism and the second maneuvering mechanism each further comprising a clamp; and the post guide being movably mounted along the variable-depth post by the clamp.

8. The hands-free kayak steering system as claimed in claim 5 comprising:

the first maneuvering mechanism and the second maneuvering mechanism each further comprising a plurality of orifices and a hand fastener;

the plurality of orifices being distributed along the variable-depth post;

the plurality of orifices being positioned normal to the post guide;

the hand fastener being rotatably connected through the post guide; and, the hand fastener being engaged with a selected orifice from the plurality of orifices.

9. The hands-free kayak steering system as claimed in claim 1 comprising:

the first maneuvering mechanism and the second maneuvering mechanism each further comprising a rearward L-shaped bracket and a rail fastener;

the rearward L-shaped bracket comprises a first rearward leg and a second rearward leg;

the rearward L-shaped bracket being positioned opposite to the quick-connect bracket about the bridging base;

the first rearward leg being laterally connected to the bridging brace;

the second rearward leg being connected perpendicular to the first rearward leg; and, the rail fastener being mounted through the second rearward leg.

10. The hands-free kayak steering system as claimed in claim 9 comprising:

the first maneuvering mechanism and the second maneuvering mechanism each further comprising a boat-accessory rail;

the boat-accessory rail being positioned perpendicular to the bridging base; and, the rail fastener being engaged into the boat-accessory rail.

11. The hands-free kayak steering system as claimed in claim 1 comprising:

a microcontroller;

a global positioning system (GPS) module;

the microcontroller and the GPS module being mounted within the bridging base;

the portable power source being electrically connected to the microcontroller and the GPS module; and, the microcontroller being electronically connected to the GPS module, the propeller assembly of the first maneuvering mechanism, and the propellor assembly of the second maneuvering mechanism.

12. A hands-free kayak steering system comprising:

a bridging base;

a first maneuvering mechanism;

a second maneuvering mechanism;

a user controller;

a portable power source;

the first maneuvering mechanism and the second maneuvering mechanism each comprising a propeller assembly, a variable-depth post, and a quick-connect bracket;

the user controller comprising a first pedal and a second pedal;

the propeller assembly being terminally connected to the variable-depth post;

the quick-connect bracket being laterally positioned to the variable-depth post, offset from the propeller assembly;

the quick-connect bracket being movably mounted along the variable-depth post;

the quick-connect bracket of the first maneuvering mechanism and the quick-connect bracket of the second maneuvering mechanism being positioned opposite to each other along the bridging base;

the quick-connect bracket of the first maneuvering mechanism and the quick-connect bracket of the second maneuvering mechanism being laterally mounted to the bridging base;

the portable power source being electrically connected to the propeller assembly of the first maneuvering mechanism and the propeller assembly of the second maneuvering mechanism;

the user controller being communicably coupled to the propeller assembly of the first maneuvering mechanism and the propeller assembly of the second maneuvering mechanism;

the user controller being mounted onto the bridging base;

the portable power source being electrically connected to the user controller;

the first pedal being positioned adjacent to the first maneuvering mechanism;

the second pedal being positioned adjacent to the second maneuvering mechanism;

the first pedal and the second pedal being laterally positioned to the bridging base;

the first pedal being pivotally mounted to the bridging base;

the second pedal being pivotally mounted to the bridging base;

the first pedal being electronically connected to the propeller assembly of the first maneuvering mechanism; and, the second pedal being electronically connected to the propeller assembly of the second maneuvering mechanism.

13. The hands-free kayak steering system as claimed in claim 12 comprising:

the variable-depth post of the first maneuvering mechanism being positioned perpendicular to the bridging base;

the variable-depth post of the second maneuvering mechanism being positioned perpendicular to the bridging base;

a first rotation axis of the propellor assembly of the first maneuvering mechanism being positioned orthogonal to the variable-depth post of the first maneuvering mechanism and the bridging base; and, a second rotation axis of the propellor assembly of the second maneuvering mechanism being positioned orthogonal to the variable-depth post of the second maneuvering mechanism and the bridging base.

14. The hands-free kayak steering system as claimed in claim 12 comprising:

a waterproof charging port;

the waterproof charging port being hermetically integrated into the bridging base;

the portable power source being mounted within the bridging base; and, the portable power source being electrically connected to the waterproof charging port.

15. The hands-free kayak steering system as claimed in claim 12 comprising:

the quick-connect bracket comprising a support rail and a post guide;

the first maneuvering mechanism and the second maneuvering mechanism each further comprising a forward L-shaped bracket and a clampable carriage;

the support rail being positioned parallel to the bridging base;

the support rail being movably connected to the bridging base;

the post guide being terminally mounted to the support rail;

the post guide being movably mounted along the variable-depth post;

the forward L-shaped bracket comprises a first forward leg and a second forward leg;

the first forward leg being laterally connected to the bridging brace;

the second forward leg being connected perpendicular to the first forward leg;

the clampable carriage being mounted through the second forward leg; and, the clampable carriage being slidably engaged along the support rail.

16. The hands-free kayak steering system as claimed in claim 15 comprising:

the first maneuvering mechanism and the second maneuvering mechanism each further comprising a clamp; and the post guide being movably mounted along the variable-depth post by the clamp.

17. The hands-free kayak steering system as claimed in claim 15 comprising:

the first maneuvering mechanism and the second maneuvering mechanism each further comprising a plurality of orifices and a hand fastener;

the plurality of orifices being distributed along the variable-depth post;

the plurality of orifices being positioned normal to the post guide;

the hand fastener being rotatably connected through the post guide; and, the hand fastener being engaged with a selected orifice from the plurality of orifices.

18. The hands-free kayak steering system as claimed in claim 12 comprising:

the first maneuvering mechanism and the second maneuvering mechanism each further comprising a rearward L-shaped bracket, a rail fastener, and a boat-accessory rail;

the rearward L-shaped bracket comprises a first rearward leg and a second rearward leg;

the rearward L-shaped bracket being positioned opposite to the quick-connect bracket about the bridging base;

the first rearward leg being laterally connected to the bridging brace;

the second rearward leg being connected perpendicular to the first rearward leg;

the rail fastener being mounted through the second rearward leg;

the boat-accessory rail being positioned perpendicular to the bridging base; and, the rail fastener being engaged into the boat-accessory rail.

19. The hands-free kayak steering system as claimed in claim 12 comprising:

a microcontroller;

a global positioning system (GPS) module;

the microcontroller and the GPS module being mounted within the bridging base;

the portable power source being electrically connected to the microcontroller and the GPS module; and, the microcontroller being electronically connected to the GPS module, the propeller assembly of the first maneuvering mechanism, and the propellor assembly of the second maneuvering mechanism.

* * * * *